US005281452A

United States Patent [19]

Cheng

[11] Patent Number: 5,281,452

[45] Date of Patent: Jan. 25, 1994

[54] ARTIFICIAL FLOWER AND METHOD OF MAKING SAME

[76] Inventor: Peter S. C. Cheng, 5 Ross Street, Toronto, Ontario, Canada, M5T 1Z8

[21] Appl. No.: 959,381

[22] Filed: Oct. 13, 1992

[51] Int. Cl.[5] ..... A41G 1/00

[52] U.S. Cl. ..... 428/24; 156/61; 428/26

[58] Field of Search ..... 428/24, 26; 156/61

[56] References Cited

U.S. PATENT DOCUMENTS 1,568,859 1/1926 Rosas ..... 428/26

2,282,657 5/1942 Kirchen ..... 428/26

2,692,449 10/1954 Jones ..... 428/24

3,565,736 2/1971 Jason ..... 428/24 X

*Primary Examiner*—Henry F. Epstein

*Attorney, Agent, or Firm*—Kirschstein et al.

[57] ABSTRACT

An artificial flower is made from a stack of juxtaposed, soft, flexible petal members having radially-extending petals, each having an enlarged head portion and a reduced neck portion. Each neck portion is twisted and maintained in a twisted state without the aid of stiffeners due to frictional engagement between adjacent head portions.

13 Claims, 2 Drawing Sheets

FIG. 1
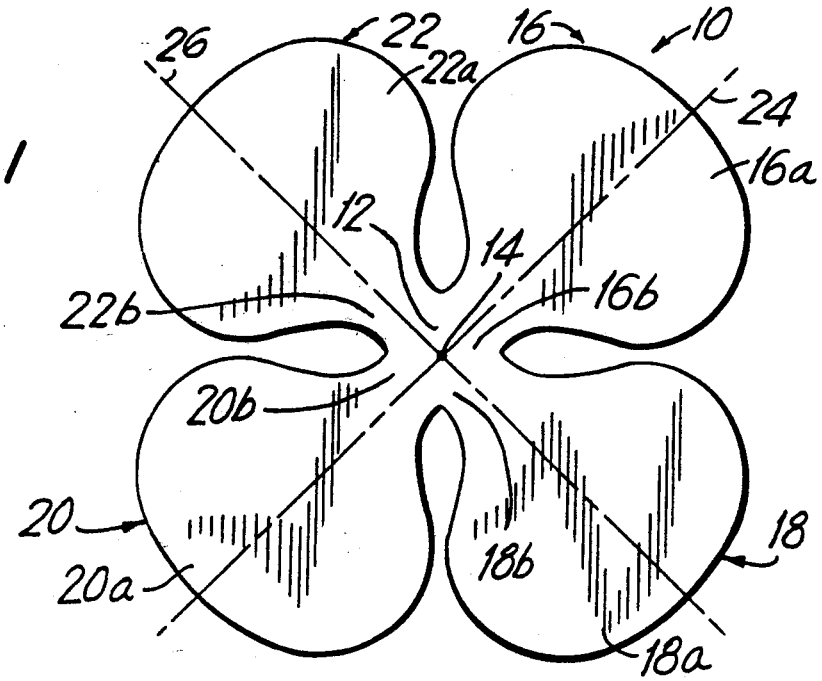
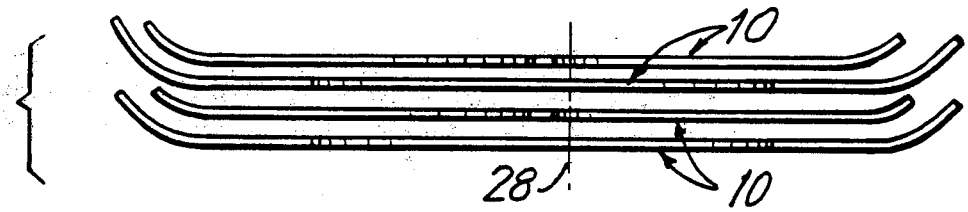
FIG. 2
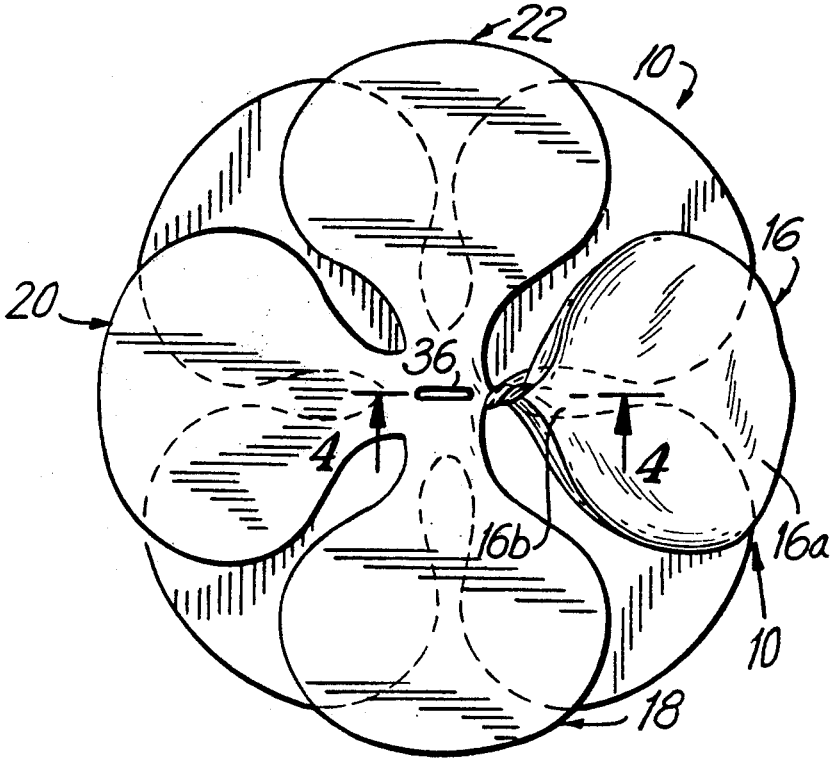
FIG. 3

ARTIFICIAL FLOWER AND METHOD OF MAKING SAME

BACKGROUND OF THE INVENTION

1. Field of the Invention

This invention generally relates to the art of making artificial flowers, especially for use as decorations.

2. Description of Related Art

U.S. Pat. Nos. 1,568,859; 2,282,657 and 3,565,736 are examples of known techniques to make artificial flowers of soft, flexible sheet material such as paper or ribbon. To effect a more realistic simulation of a natural flower, it is desired to twist, kink and otherwise manipulate the flexible material. However, the flexible material does not readily maintain its shape after such manipulation. Hence, the art has turned to using stiffeners, such as bendable metal wire, with such sheet material. To prevent the wires from being seen, they are typically sewn or woven into the sheet material. The need persists for making a more realistic simulation of a natural flower from soft, flexible materials without the use of such bendable wires and analogous stiffeners which contribute significantly to the overall cost of the flower.

SUMMARY OF THE INVENTION

1. Objects of the Invention

It is a general object of this invention to eliminate the need for bendable wires and analogous stiffeners in the making of artificial flowers from soft, flexible sheet material.

It is another object of this invention to make such artificial flowers in an inexpensive and rapid manner.

Another object of this invention is to provide a novel method of making such flowers without requiring high training or dexterity skills.

2. Features of the Invention

In keeping with these objects, and others which will become apparent hereinafter, one feature of this invention resides, briefly stated, in an artificial flower and method of making the same. A plurality of petal members are formed, preferably by cutting them from sheet material such as paper or fabric. Each petal member has a central portion and a plurality of petals extending radially outwardly from the central portion along respective petal axes. Each petal has an enlarged head portion and a reduced neck portion.

Thereupon, the petal members are stacked one above another by overlying each central portion. The central portions of the petal members are thereupon connected together. For example, they may be tied by a string, wrapped with a tape, or adhered together with glue, to form an assembly. Preferably, the petal members are angularly offset relative to one another with respect to a vertical stacking axis.

In further accordance with this invention, each neck portion is twisted about a respective petal axis to a twisted state, and is maintained in its twisted state due to frictional engagement between adjacent head portions. More specifically, the head portion of each petal is manually held, and then turned a few revolutions about its respective petal axis, thereby twisting the neck portion. The head portion is then released and the twisted petal starts to untwist. However, due to the wide widths of adjacent enlarged head portions, the untwisting of a twisted petal stops due to frictional engagement between adjacent head portions. Hence, the twisted state of each petal is maintained without the aid of auxiliary stiffeners.

In the preferred embodiment, each petal member has a cloverleaf pattern with four petals mirror-symmetrically arranged with respect to a pair of mutually orthogonal petal axes. Furthermore, prior to performing the stacking step, it is desired to curl each petal by imparting it with a cupped shape. This is conveniently accomplished by the application of manual pressure along the top surface of each petal along a respective petal axis, together with the simultaneous application of heat.

In order to use the artificial flower as a decoration on an object such as a gift package, an adhesive fastener is secured to the flower. The fastener includes a backing sheet covered with a pressure-sensitive adhesive layer over which a peel-off protective tab is laid. Removal of the tab exposes the adhesive and allows the fastener to be pressed against the object to be decorated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a top plan view of a petal member used in the making of an artificial flower in accordance with this invention;

FIG. 2 is a side elevational view of a stack of petal members;

FIG. 3 is a top plan view showing the twisting of a petal;

DETAILED DESCRIPTION OF THE PREFERRED EMBODIMENTS

Figure 4:
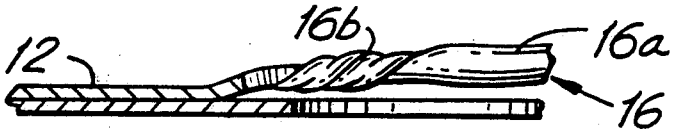
FIG. 4 is a sectional view taken on line 4—4 of FIG. 3.
Figure 5:
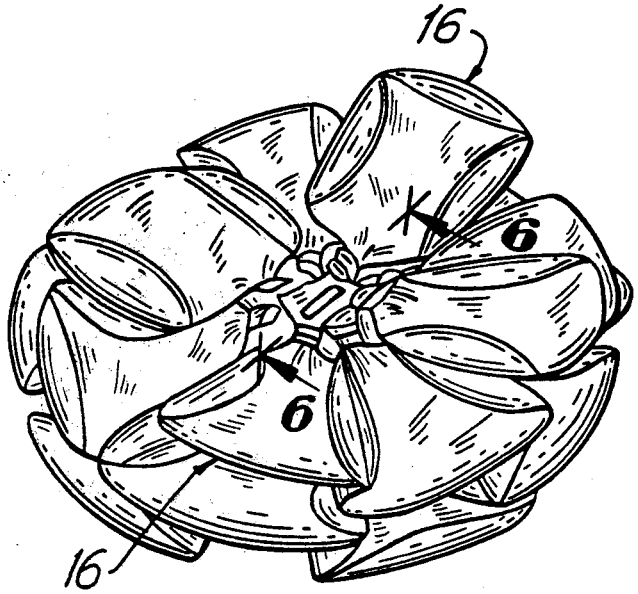
FIG. 5 is a perspective view of an artificial flower.
Figure 6:
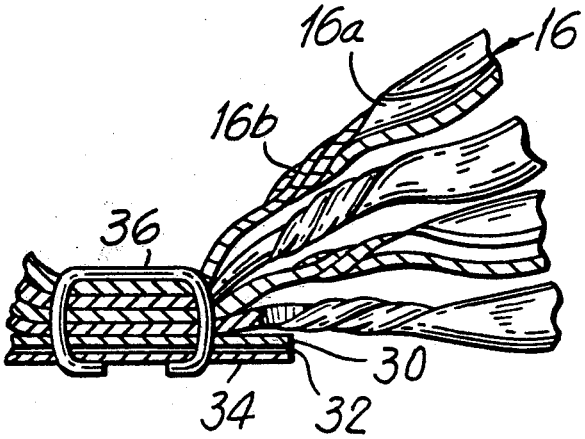
FIG. 6 is a sectional view taken on line 6—6 of FIG. 5.

Referring now to the drawings, reference numeral 10 in FIG. 1 generally identifies a single petal member. Multiple petal members 10 are used to make an artificial flower (see FIG. 5) in accordance with this invention. Each petal member 10 is formed preferably by being die-cut from a piece of soft, flexible, non-rigid sheet material, e.g. paper or fabric. All the members 10 may be cut from the same or different pieces of sheet material. The sheet material is preferably colored, and different pieces of sheet material may have the same or different colors. Even the same sheet material may have various colors thereon.

Each petal member 10 has, as illustrated, a cloverleaf design, and includes a central portion 12 having a center 14. A plurality, preferably four, of petals 16, 18, 20, 22 extend radially outwardly from the center 14 along the mutually orthogonal petal axes 24, 26. Petals 16, 20 are mirror-symmetrically arranged on opposite sides of axis 26. Petals 18, 22 are mirror-symmetrically arranged on opposite sides of axis 24. Petals 16, 18, 20, 22 respectively have enlarged, wide head portions **16*a*, 18*a*, 20*a*, 22*a*, and reduced, narrow neck portions 16*b*, 18*b*, 20*b*, 22*b*. Each head portion is outwardly flared relative to its respective neck portion, and has a wider dimension than its corresponding neck portion. For example, head portion 16***a* has a greater width, as considered in a direction generally perpendicular to axis 24, as compared to the width of its corresponding neck portion 16*b*.

The next step in making the flower is the curling of the petals. This is advantageously done by applying pressure along the top surface of each petal, preferably together with the simultaneous application of heat. For example, in the case of petal 16, pressure is applied from the neck portion 16*b* along the axis 24 to the head portion 16*a*, thereby deforming the petal into a concave cupped shape.

Thereupon, a plurality of petal members 10, after the curling step has been performed for each petal, are stacked one above another along a vertical stacking axis 28 on which each center 14 lies. Adjacent petal members are mutually angularly offset relative to the stacking axis 28 to create a fuller flower.

Thereupon, the central portions 12 of all the petal members 10 are interconnected. For example, this may be accomplished by being tied together with a common string or rope, or by being wrapped together by a common tape, or by being stapled together with a common staple 36. Other forms of interconnection are, of course, possible. For example, adhesives between petal members can be employed.

Each neck portion is then twisted about a respective petal axis for a plurality of turns to assume a twisted state. For instance, the head portion 16*a* of petal 16 is held between the thumb and forefinger of a human assembler, and then turned a few revolutions, e.g. two or three times, about petal axis 24, thereby twisting the neck portion 16*b*. The head portion 16*a* is then released, and the petal 16 starts to untwist. However, due to the wide width of adjacent head portions, the untwisting of a twisted petal stops due to frictional engagement between adjacent head portions. Hence, the twisted state of each petal is maintained without the aid of auxiliary stiffeners such as metal wires due to said frictional engagement.

In order to use the flower as a decoration on an object, e.g. a gift package, a detachable fastener (see FIG. 5) is stapled below the flower. The fastener includes a backing sheet 30, an adhesive coating 32 applied thereon, and a peel-off protective tab 34 overlying the adhesive layer. By peeling off the tab 34, the adhesive is exposed and the fastener may then be applied by pressure against the object and adhered thereto.

Rather than a smooth, outer periphery for each petal member, this invention also contemplates providing a serrated outer periphery to more closely simulate different flowers.

It will be understood that each of the elements described above, or two or more together, also may find a useful application in other types of constructions differing from the types described above.

While the invention has been illustrated and described as embodied in an artificial flower and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A method of making an artificial flower, comprising the steps of:

(a) forming a plurality of petal members, each having a central portion, and a plurality of petals extending radially outwardly from the central portion along respective petal axes, each petal having an enlarged head portion and a reduced neck portion;

(b) stacking the petal members, one above another, by overlying each central portion;

(c) connecting each central portion of the petal members together to form an assembly; and (d) twisting each neck portion by turning each neck portion through a plurality of revolutions about a respective petal axis to a twisted state, and maintaining the twisted state solely due to frictional engagement between adjacent head portions.

2. The method according to claim 1, wherein the forming step is performed by cutting the petal members from sheet material.

3. The method according to claim 2, wherein the forming step is performed by cutting two pairs of petals from the sheet material, one of said pairs being mirror-symmetrically arranged on one of the petal axes, and another of said pairs being mirror-symmetrically arranged on another of the petal axes, said one and another of the petal axes lying at right angles to each other.

4. The method according to claim 2, wherein the forming step is performed by integrally forming the petals with the central portion of each petal member.

5. The method according to claim 1; and further comprising the step of angularly offsetting the petal members relative to one another about a stacking axis along which the petal members are stacked.

6. The method according to claim 1, wherein the connecting step is performed by tying the central portions of the petal members together.

7. The method according to claim 1; and further comprising the step of curling each petal prior to performing the stacking step.

8. An artificial flower, comprising:

a plurality of petal members stacked, one above another, along a stacking axis, each petal member having a central portion and a plurality of petals extending radially from the stacking axis and outwardly of the central portion along respective petal axes, each petal having an enlarged head portion and a reduced neck portion twisted and turned through a plurality of revolutions about a respective petal axis to a twisted shape, each head portion frictionally engaging an adjacent head portion to maintain said twisted shape solely due to such frictional engagement, said petal members being interconnected at their respective central portions to form an assembly.

9. The artificial flower according to claim 8, wherein each petal member is constituted of sheet material.

10. The artificial flower according to claim 8, wherein the central portion and the petals of each petal member are of one-piece construction.

11. The artificial flower according to claim 8, wherein each petal member has a cloverleaf shape.

12. The artificial flower according to claim 11, wherein each petal member has a first pair of petals mirror-symmetrically arranged along a first of the petal axes, and a second pair of petals mirror-symmetrically arranged along a second of the petal axes, said first and second axes lying at right angles to each other.

13. The artificial flower according to claim 8; and further comprising means for securing the assembly to an object.

* * * * *